US011760449B2

(12) United States Patent
Liu et al.

(10) Patent No.: US 11,760,449 B2
(45) Date of Patent: Sep. 19, 2023

(54) METHOD FOR PREDICTING HEAVING MOTION PARAMETERS OF SEMI-SUBMERSIBLE OFFSHORE PLATFORM BASED ON HEAVING ACCELERATION

(71) Applicant: Ocean University of China, Qingdao (CN)

(72) Inventors: Fushun Liu, Qingdao (CN); Shujian Gao, Qingdao (CN); Zhe Tian, Qingdao (CN); Yuanchuan Liu, Qingdao (CN)

(73) Assignee: Ocean University of China, Qingdao (CN)

( * ) Notice: Subject to any disclaimer, the term of this patent is extended or adjusted under 35 U.S.C. 154(b) by 0 days.

(21) Appl. No.: 17/775,321

(22) PCT Filed: Nov. 9, 2021

(86) PCT No.: PCT/CN2021/129514
§ 371 (c)(1),
(2) Date: May 9, 2022

(87) PCT Pub. No.: WO2022/142746
PCT Pub. Date: Jul. 7, 2022

(65) Prior Publication Data

US 2023/0129913 A1 Apr. 27, 2023

(30) Foreign Application Priority Data

Dec. 30, 2020 (CN) ..... 202011619590.8

(51) Int. Cl.
*B63B 79/20* (2020.01)
*B63B 79/10* (2020.01)

(52) U.S. Cl.
CPC ..... *B63B 79/10* (2020.01); *B63B 79/20* (2020.01)

(58) Field of Classification Search
CPC ..... B63B 79/10; B63B 79/20
See application file for complete search history.

(56) References Cited

U.S. PATENT DOCUMENTS

2009/0043436 A1 2/2009 Igarashi et al.
2018/0372494 A1* 12/2018 Tamashima ..... G01C 23/00

FOREIGN PATENT DOCUMENTS

CN 107600352 A 1/2018
CN 108549616 A 9/2018
(Continued)

*Primary Examiner* — Roy Y Yi
*Assistant Examiner* — Geoffrey T Evans
(74) *Attorney, Agent, or Firm* — Bayramoglu Law Offices LLC

(57) ABSTRACT

A method for predicting heaving motion parameters of a semi-submersible offshore platform based on heaving acceleration includes: in heaving motion of a semi-submersible offshore platform, representing heaving acceleration of the semi-submersible offshore platform based on a linear potential flow theory; considering a noise influence of a heaving motion measurement marine environment, a low-frequency influence caused by a slow change of the environment and an influence caused by a baseline drift error of an acceleration sensor, introducing a noise term, a low-frequency change term and a baseline drift error term, and uniformly representing the noise term, the low-frequency change term and the baseline drift error term by a unified Prony sequence; and removing a drift term from uniformly represented heaving acceleration, establishing a relationship between the heaving acceleration and heaving motion parameters in terms of the remaining Prony sequence with the drift term being removed, and estimating the heaving motion parameters.

6 Claims, 5 Drawing Sheets

(56) References Cited

FOREIGN PATENT DOCUMENTS

| | | | |
|---|---|---|---|
| CN | 109446634 | A | 3/2019 |
| CN | 111336996 | A | 6/2020 |
| CN | 112693578 | A | 4/2021 |

* cited by examiner

METHOD FOR PREDICTING HEAVING MOTION PARAMETERS OF SEMI-SUBMERSIBLE OFFSHORE PLATFORM BASED ON HEAVING ACCELERATION

CROSS REFERENCE TO THE RELATED APPLICATIONS

This application is the national phase entry of International Application No. PCT/CN2021/129514, filed on Nov. 9, 2021, which is based upon and claims priority to Chinese Patent Application No. 202011619590.8, filed on Dec. 30, 2020, the entire contents of which are incorporated herein by reference.

TECHNICAL FIELD

The invention belongs to the technical field of heaving motion of semi-submersible platforms, and particularly relates to a method for predicting heaving motion parameters of a semi-submersible offshore platform based on heaving acceleration.

BACKGROUND

In the operating process of semi-submersible platforms, many marine technologies are applied based on heaving motion of structures, so it is of crucial importance to monitor the heaving motion of the semi-submersible platforms. For example, the heaving motion of the semi-submersible platforms is one of important external forces of a riser system, has a direct influence on the overall dynamic response analysis of the riser system, and seriously affects the stability of a vertical transport system. For another example, during the installation of offshore structures, high-precision monitoring of the heaving motion can effectively improve the installation efficiency of offshore structures. In addition, the motion of the semi-submersible platforms and the change of the water surface under severe sea conditions will lead to a change of the value of an air gap of the platforms, and a negative air gap may cause damage to the platforms and even cause personnel casualties.

With the development of the global positioning system, the heaving motion of most semi-submersible platforms is located and monitored based on the global positioning system at present. However, the global positioning system has low sampling efficiency which is generally not over 20 Hz, and poor precision, and may cause the loss of necessary motion information under some extremely severe conditions.

Although heaving velocity information of a structure can be obtained theoretically by integrating the heaving acceleration and heaving motion parameter information of the structure can be obtained by further integration, during an actual test, the initial velocity and initial displacement of the structure are unknown, so a drift of the integration result will be caused. Moreover, an inevitable baseline error of an acceleration sensor used for a field test will lead to a great error of the result. In order to estimate heaving motion information of the structure in terms of the heaving acceleration of the structure, Richter et al. put forward three phase correction methods for reducing integration errors based on an inertial measurement unit, by using adaptive heaving filters. An error function is deduced by performing error analysis on each filter, and then the error function is minimized to obtain optimal parameters of each filter. Kchler et al. deduced an observer for estimating heaving motion parameters using the inertial measurement unit as an independent motion sensor. In this method, the heaving motion is approximate to superimposed sine waves; then, the accurately approximate sine waves and a corresponding frequency are recognized by fast Fourier transform; and finally, an observer model for estimating the heaving motion is established by means of the recognized parameters. However, this method filters out drifted terms by filtering, which will inevitably cause the loss of information in heaving motion parameters, thus resulting in an inaccurate estimation result.

SUMMARY

In view of the defects of above-mentioned existing methods, the objective of the invention is to provide a method for predicting heaving motion parameters of a semi-submersible offshore platform based on heaving acceleration, which deduces a motion equation of a structure in a heaving direction based on a linear potential flow theory and establishes the relationship between heaving acceleration and heaving motion parameters of a semi-submersible offshore platform through a Prony sequence, thus avoiding errors caused by traditional methods based on filters and having high calculation precision and practicability.

To fulfill the above objective, the invention provides a method for predicting heaving motion parameters of a semi-submersible offshore platform based on heaving acceleration, comprising:

- in heaving motion of a semi-submersible offshore platform, representing heaving acceleration of the semi-submersible offshore platform based on a linear potential flow theory without regard to a coupling influence of addition mass and radiation damping to determine a heaving acceleration theoretical value;
- in consideration of a noise influence of a heaving motion measurement marine environment of the semi-submersible offshore platform, a low-frequency influence caused by a slow change of the environment and an influence caused by a baseline drift error of an acceleration sensor, introducing a noise term, a low-frequency change term and a baseline drift error term to determine a heaving acceleration measured value;
- uniformly representing a heaving acceleration theoretical value term, the noise term, the low-frequency change term and the baseline drift error term in the heaving acceleration measured value by a unified Prony sequence; and
- removing a drift term from the uniformly represented heaving acceleration, establishing a relationship between the heaving acceleration and heaving motion parameters of the semi-submersible offshore platform in terms of the remaining Prony sequence with the drift term being removed, and estimating the heaving motion parameters of the semi-submersible offshore platform.

Preferably, in the heaving motion of the semi-submersible offshore platform, without regard to the coupling influence of the addition mass and the radiation damping and in consideration of a wave force, a restoring force and a radiation force applied to the semi-submersible offshore platform in fluid, the heaving motion is expressed, based on the linear potential flow theory, as:

$$m\ddot{z}_0(t)=f_w(t)+f_m(t)+f_s(t)+f_r(t) \quad (1).$$

In the formula, m represents mass of the semi-submersible offshore platform, $\ddot{z}_0(t)$ represents the heaving acceleration of the semi-submersible offshore platform, $f_w(t)$ represents a wave load applied to the semi-submersible offshore platform, $f_m(t)$ represents a mooring force applied to the semi-submersible offshore platform, $f_s(t)$ represents the restoring force applied to the semi-submersible offshore platform, and $f_r(t)$ represents the radiation force applied to the semi-submersible offshore platform;

wherein the restoring force $f_s(t)$ is expressed as:

$$f_s(t)=-c_z z_o(t)=-\rho g A_w z_o(t) \quad (2).$$

In the formula, $z_o(t)$ represents a vertical displacement of the semi-submersible offshore platform; $c_z$ is restoring stiffness of the semi-submersible offshore platform in the heaving direction, which is related to an area $A_w$ of a water plane, a fluid density ρ and gravitational acceleration g.

The radiation force $f_r(t)$ is expressed as:

$$f_r(t)=-m_\infty \ddot{z}_0(t)\int_0^t k_z(t-\tau)\dot{z}_o(t)d\tau \quad (3).$$

In the formula, $\dot{z}_o(t)$ represents a velocity of the semi-submersible offshore platform in the heaving direction, and $m_\infty$ and $k_z$ are additional mass and a pulse response function at an infinite frequency in the heaving direction.

In terms of formulae (1)-(3), the heaving motion of the semi-submersible offshore platform is expressed as:

$$(m+m_\infty)\ddot{z}_0(t)=f_o(t)-c_z z_o(t)-\int_0^t k_z(t-\tau)\dot{z}_o(t)d\tau \quad (4).$$

In the formula, $f_0(t)=f_w(t)+f_m(t)$.

So, the heaving acceleration theoretical value of the semi-submersible offshore platform is expressed as:

$$\ddot{z}_0(t)=\frac{1}{m+m_\infty}\left\{f_0(t)-c_z z_0(t)-\int_0^t k_z(t-\tau)\dot{z}_0(t)d\tau\right\}. \quad (5)$$

Theoretically, the heaving acceleration of the semi-submersible offshore platform is modeled into a group of superimposed harmonic waves, so in terms of formula (5), the heaving acceleration theoretical value is represented as:

$$\ddot{z}_0(t)=\Sigma_{i=1}^{N_i}A_i\cos(2\pi f_i t+\theta_i)=\Sigma_{i=1}^{N_i}U_i e^{v_i t} \quad (6).$$

In the formula, $A_i$, $f_i$, and $\theta_i$ represent an amplitude, a frequency and a phase of an $i^{th}$ component in the heaving acceleration respectively, and $U_i$ and $V_i$ are parameters used for fitting the heaving acceleration theoretical value of the semi-submersible offshore platform by the Prony sequence.

Preferably, in consideration of the noise influence of the heaving motion measurement marine environment of the semi-submersible offshore platform, the low-frequency influence caused by the slow change of the environment and the influence caused by the baseline drift error of the acceleration sensor, the heaving acceleration measured value determined by introducing the noise term, the low-frequency change term and the baseline drift error term is:

$$\ddot{z}_0(t)=\ddot{z}_o(t)+n(t)+v(t)+b \quad (7)$$

In the formula, n(t) represents the noise term, v(t) represents the low-frequency change term, and b represents the baseline drift error term.

Preferably, the Prony sequence is introduced to represent the noise term, the low-frequency change term and the baseline drift error term in the heaving acceleration measured value as follows:

$$n(t)=\Sigma_{n=1}^{N_n}A_n e^{i\theta_n}e^{(-\xi_n+j2\pi f_n)t}=\Sigma_{n=1}^{N_n}\mathcal{A}_n e^{\mathcal{B}_n t} \quad (8).$$

In the formula, $j=\sqrt{-1}$, $\mathcal{A}_n=A_n e^{i\theta_n}$, $\mathcal{B}_n=-\xi_n+j2\pi f_n$, wherein $A_n$, $f_n$, $\zeta_n$ and $\theta_n$ represent an amplitude, a frequency, damping and a phase of each component in the noise term respectively.

$$v(t)=\Sigma_{v=1}^{N_v}A_v e^{j\theta_v}e^{(-\xi_v+j2\pi f_v)t}=\Sigma_{v=1}^{N_v}C_v e^{D_v t} \quad (9).$$

In the formula, $C_v=A_v e^{i\theta_v}$, $D_v=-\xi_v+j2\pi f_v$, wherein $A_v$, $f_v$, $\zeta_v$ and $\theta_v$, represent an amplitude, a frequency, damping and a phase of each component in the low-frequency change term respectively.

$$b=Ee^{Ft} \quad (10).$$

In the formula, E and F are parameters used for fitting the baseline drift error.

In terms of formulae (6)-(10), the heaving acceleration theoretical value term, the noise term, the low-frequency change term and the baseline drift error term in the heaving acceleration measured value are represented by the unified Prony sequence to obtain:

$$\ddot{z}_0(t)=\Sigma_{i=1}^{N_i}U_i e^{v_i t}+\Sigma_{n=1}^{N_n}\mathcal{A}_n e^{\mathcal{B}_n t}+\Sigma_{v=1}^{N_v}C_v e^{D_v t}+Ee^{Ft} \quad (11)$$

Further, the heaving acceleration measured value is uniformly represented as:

$$\ddot{z}_0(t)=\Sigma_{p=1}^{N_p}\mathcal{P}_p e^{Q_p t} \quad (12)$$

In the formula, $N_p=N_i+N_n+N_v+1$, $\mathcal{P}_p$ and $Q_p$ are Prony sequence parameters used for uniformly representing the heaving acceleration of the semi-submersible offshore platform by the Prony sequence.

Preferably, frequencies of all components of the uniformly represented heaving acceleration are determined according to the calculated Prony sequence parameter $Q_p$, that is:

$$f_p=\frac{Q_p+\mathcal{P}_p}{j2\pi}. \quad (13)$$

The determined frequencies are ordered, a minimum frequency component, namely the drift term, is removed from the frequencies to obtain the uniformly represented heaving acceleration measured value with the drift term being removed:

$$\bar{\ddot{z}}_0(t)=\Sigma_{q=1}^{N_q}\mathcal{P}_q e^{Q_q t} \quad (14)$$

In the formula, $\mathcal{P}_q$ and $Q_q$ are Prony sequence parameters used for uniformly representing the heaving acceleration measured value with the drift term being removed by the Prony sequence.

Preferably, a heaving motion response is determined according to the uniformly represented heaving acceleration measured value with the drift term being removed:

$$\iint_0^T \bar{\ddot{z}}_0(t)dtdt=z_0(t)+\dot{z}(0)+\dot{z}(0)t \quad (15)$$

That is, the relationship between the heaving acceleration and the heaving motion parameters is:

$$\int\int_0^T \sum_{q=1}^{N_q}\mathcal{P}_q e^{Q_q t}dtdt=\sum_{q=1}^{N_q}\frac{\mathcal{P}_q}{Q_q^2}e^{Q_q t}+\sum_{q=1}^{N_q}\frac{\mathcal{P}_q}{Q_q^2}+\sum_{q=1}^{N_q}\frac{\mathcal{P}_q}{Q_q}t. \quad (16)$$

Actual heaving motion parameters of the semi-submersible offshore platform are represented as:

$$z_0(t) = \sum_{q=1}^{N} \frac{\mathcal{P}_q}{Q_q^2} e_o^{Q_q t}. \tag{17}$$

Compared with the prior art, the invention has the following advantages and beneficial effects:

According to the method for predicting heaving motion parameters of a semi-submersible offshore platform based on heaving acceleration provided by the invention, a motion equation of heaving motion parameters of the semi-submersible offshore platform is deduced based on the linear potential flow theory without regard to the coupling influence of addition mass and radiation damping in the heaving motion, and a mathematic model of the heaving acceleration of the structure under the action of waves is established. Moreover, the influences of the environment and equipment on the heaving acceleration of the tested semi-submersible offshore platform are considered in many aspects, including the noise influence of the complex marine environment, the low-frequency influence caused by a slow tide change and the influence caused by a baseline drift error of the acceleration sensor, so that a calculation result is more aligned with the actual seal condition and has high practical application value. In addition, the heaving acceleration of the semi-submersible offshore platform, environmental noise, a tide changes and a baseline drift of a sensor are uniformly represented by a unified Prony sequence, frequencies of all components are screened and removed, and a transformational relation between the heaving acceleration and heaving motion parameters is established through the remaining Prony sequence, so that the prediction of the heaving motion parameters of the semi-submersible offshore platform is realized; and the method has high calculation precision and practicability and avoids errors caused by traditional methods based on filters.

BRIEF DESCRIPTION OF THE DRAWINGS

FIGS. 3A and 3B illustrate time-domain diagrams of the heaving acceleration and displacement of the semi-submersible offshore platform tested by an acceleration sensor and an optical six-degree-of-freedom instrument, wherein FIG. 3A is a time-domain diagram of the heaving acceleration, and FIG. 3B is a time-domain diagram of heaving motion parameters.

FIGS. 4A and 4B illustrate fitting results of heaving acceleration measured with Prony parameters, wherein FIG. 4A is a fitting result of the heaving acceleration obtained according to a Prony signal, and FIG. 4B is a fitting result obtained according to local acceleration signals within 100-110 s.

FIGS. 5A and 5B illustrate heaving motion parameter results of the semi-submersible offshore platform reconstructed through the method of the invention, wherein FIG. 5A is a comparison diagram of a structure displacement reconstructed through the method of the invention and a test displacement, and FIG. 5B is an estimation result obtained according to local heaving signals within 100-110 s.

DETAILED DESCRIPTION OF THE EMBODIMENTS

Specific implementations of the invention will be further described below in conjunction with the accompanying drawings.

Figure 1:
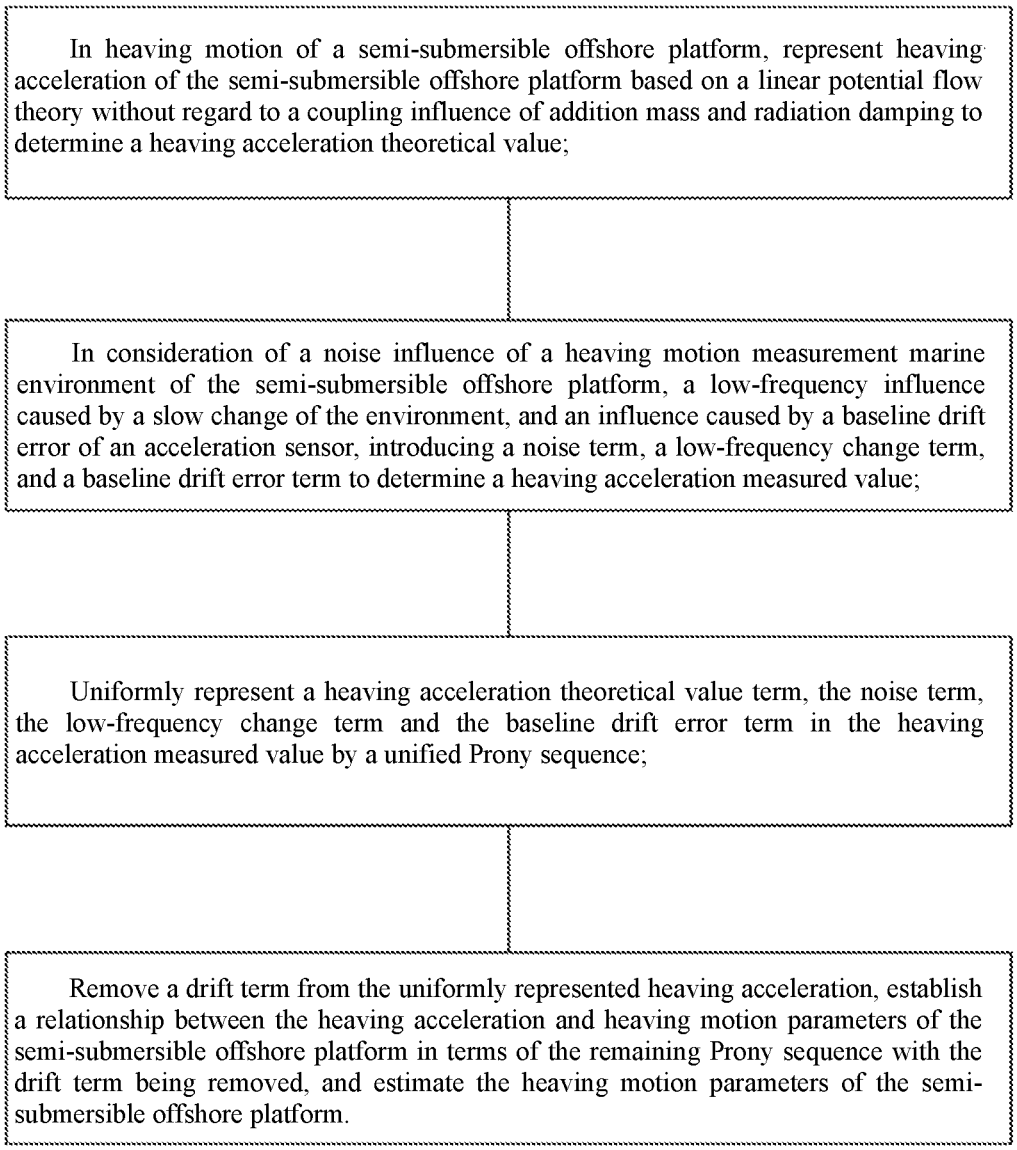
FIG. 1 is an overall flow diagram of a method for predicting heaving motion parameters of a semi-submersible offshore platform based on heaving acceleration according to the invention.

The invention provides a method for predicting heaving motion parameters of a semi-submersible offshore platform based on heaving acceleration, which, as shown in FIG. 1, specifically comprises:

(1) in heaving motion of a semi-submersible offshore platform, heaving acceleration of the semi-submersible offshore platform is represented based on a linear potential flow theory without regard to a coupling influence of addition mass and radiation damping to determine a heaving acceleration theoretical value. Specifically:

In the heaving motion of the semi-submersible offshore platform, without regard to the coupling influence of the addition mass and the radiation damping and in consideration of a wave force, a restoring force and a radiation force applied to the semi-submersible offshore platform in fluid, the heaving motion is represented, based on the linear potential flow theory, as:

$$m\ddot{z}_0(t)=f_w(t)+f_m(t)+f_s(t)+f_r(t) \tag{1}$$

In the formula, m represents the mass of the semi-submersible offshore platform, $\ddot{z}_0(t)$ represents the heaving acceleration of the semi-submersible offshore platform, $f_w(t)$ represents a wave load applied to the semi-submersible offshore platform, $f_m(t)$ represents a mooring force applied to the semi-submersible offshore platform, $f_s(t)$ represents the restoring force applied to the semi-submersible offshore platform, and $f_r(t)$ represents the radiation force applied to the semi-submersible offshore platform, wherein, the restoring force $f_s(t)$ is expressed as:

$$f_s t=-c_z z_o(t)=-\rho g A_w z_o(t) \tag{2}$$

In the formula, $z_o(t)$ represents a vertical displacement of the semi-submersible offshore platform; $c_z$ is restoring stiffness of the semi-submersible offshore platform in the heaving direction, which is related to the area $A_w$ of a water plane, a fluid density $\rho$ and gravitational acceleration g.

The radiation force $f_r(t)$ is expressed as:

$$f_r(t)=-m_\infty \ddot{z}_0(t)\int_0^t k_z(t-\tau)\dot{z}_o(t)d\tau \tag{3}$$

In the formula, $\dot{z}_o(t)$ represents a velocity of the semi-submersible offshore platform in the heaving direction, and $m_\infty$ and $k_z$ are additional mass and a pulse response function at an infinite frequency in the heaving direction.

In terms of formulae (1)-(3), the heaving motion of the semi-submersible offshore platform is expressed as:

$$(m+m_\infty)\ddot{z}_0(t)=f_o(t)-c_z z_o(t)-\int_0^t k_z(t-\tau)\dot{z}_o(t)d\tau \tag{4}$$

In the formula, $f_0(t)=f_w(t)+f_m(t)$.

So, the heaving acceleration theoretical value of the semi-submersible offshore platform is expressed as:

$$\ddot{z}_0(t) = \frac{1}{m+m_\infty}\left\{f_0(t) - c_z z_0(t) - \int_0^{\tau} k_z(t-\tau)\dot{z}_0(t)d\tau\right\}. \tag{5}$$

Theoretically, the heaving acceleration of the semi-submersible offshore platform is modeled into a group of superimposed harmonic waves, and in terms of formula (5), the heaving acceleration theoretical value is represented as:

$$\ddot{z}_0(t)=\Sigma_{i=1}^{N_i}A_i\cos(2\pi f_i t+\theta_i)=\Sigma_{i=1}^{N_i}U_i e^{V_i t} \tag{6}$$

In the formula, $A_i$, $f_i$, and $\theta_i$ represent an amplitude, a frequency and a phase of an $i^{th}$ component in the heaving acceleration respectively, and $U_i$ and $V_i$ are parameters used for fitting the heaving acceleration theoretical value of the semi-submersible offshore platform by a Prony sequence.

So, in this embodiment, as for the semi-submersible offshore platform under the action of waves, a theoretical model of the heaving acceleration of the semi-submersible offshore platform is established based on the linear potential flow theory, in consideration of the wave force, restoring force and radiation force applied to the semi-submersible offshore platform in fluid and without regard to the coupling influence of the additional mass and the radiation damping in the heaving motion.

(2) In an actual operating environment of the semi-submersible offshore platform, in addition to the motion of the structure, a large quantity of noise interference will be generated by the complex marine environment and machine operation, so the measured heaving acceleration contains a large quantity of environmental noise and an effect caused by a slow change of the fluid. Moreover, due to the self-constraints of an acceleration sensor, an error will be inevitably caused by a baseline drift of the acceleration sensor. So, in consideration of a noise influence of a heaving motion measurement marine environment of the semi-submersible offshore platform, a low-frequency influence caused by a slow change of the environment and an influence caused by a baseline drift error of the acceleration sensor, a noise term, a low-frequency change term and a baseline drift error term are introduced to determine a heaving acceleration measured value:

$$\ddot{z}_0(t)=\ddot{z}_o(t)+n(t)+v(t)+b \tag{7}$$

In the formula, n(t) represents the noise term, v(t) represents the low-frequency change term, and b represents the baseline drift error term.

In this embodiment, as for a heaving acceleration response of the semi-submersible offshore platform under the action of waves, in addition to the motion of the structure under the wave motion, the noise term caused by the marine environment and machine operation, as well as the slow change effect caused by a tidal range are taken into consideration, and a baseline drift inevitably caused by the acceleration sensor used for testing is also taken into consideration, so compared with the representation of the heaving motion parameters of the semi-submersible platform merely by superposition of harmonic waves, the representation of the heaving acceleration in this embodiment is more aligned with the operating state of the structure in the actual marine environment.

(3) A heaving acceleration theoretical value term, the noise term, the low-frequency change term and the baseline drift error term in the heaving acceleration measured value are uniformly represented by a unified Prony sequence, specifically:

The Prony sequence (7) is introduced to represent the noise term, the low-frequency change term and the baseline drift error term in the heaving acceleration measured value as follows:

$$n(t)=\Sigma_{n=1}^{N_n}A_n e^{i\theta_n}e^{(-\xi_n+j2\pi f_n)t}=\Sigma_{n=1}^{N_n}\mathcal{A}_n e^{\mathcal{B}_n t} \tag{8}$$

In the formula, $j=\sqrt{-1}$, $\mathcal{A}_n=A_n^{ej\theta_n}$, $\mathcal{B}_n=-\xi_n+\zeta n+j2\pi f_n$, wherein $A_n$, $f_n$, $\zeta_n$ and $\theta_n$ represent an amplitude, a frequency, damping and a phase of each component in the noise term respectively.

$$v(t)=\Sigma_{v=1}^{N_v}A_v e^{j\theta_v}e^{(-\xi_v+j2\pi f_v)t}=\Sigma_{v=1}^{N_v}C_v e^{D_v t} \tag{9}$$

In the formula, $C_v=A_v e^{i\theta_v}$, $D_v=-_v+j2\pi f_v$, wherein $A_v$, $f_v$, $\zeta_v$ and $\theta_v$ represent an amplitude, a frequency, damping and a phase of each component in the low-frequency change term respectively.

$$b=Ee^{Ft} \tag{10}$$

In the formula, E and F are parameters used for fitting the baseline drift error.

In terms of formulae (6)-(10), the heaving acceleration theoretical value term, the noise term, the low-frequency change term and the baseline drift error term in the heaving acceleration measured value are represented by the unified Prony sequence to obtain:

$$\ddot{z}_0(t)=\Sigma_{i=1}^{N_i}U_i e^{V_i t}+\Sigma_{n=1}^{N_n}\mathcal{A}_n e^{\mathcal{B}_n t}+\Sigma_{v=1}^{N_v}C_v e^{D_v t}+Ee^{Ft} \tag{11}$$

Further, the heaving acceleration measured value is uniformly represented as:

$$\ddot{z}_0(t)=\Sigma_{p=1}^{N}\mathcal{P}_p e^{\mathcal{Q}_p t} \tag{12}$$

In the formula, $N_p=N_i+N_n+N_v+1$, $\mathcal{P}_p$ and $Q_p$ are Prony sequence parameters used for uniformly representing the heaving acceleration of the semi-submersible offshore platform by the Prony sequence.

In this embodiment, based on the Prony sequence that is able to fit direct-current signals, harmonic signals and increasing (decreasing) vibration signals, the noise component, the slow change caused by tide changes and a baseline drift error term caused by the acceleration sensor in the heaving acceleration are represented respectively, so that the heaving acceleration of the semi-submersible offshore platform is uniformly represented by a Prony sequence.

(4) A drift term is removed from the uniformly represented heaving acceleration, a relationship between the heaving acceleration and heaving motion parameters of the semi-submersible offshore platform is established in terms of the remaining Prony sequence with the drift term being removed, and the heaving motion parameters of the semi-submersible offshore platform are estimated, specifically:

Frequencies of all components of the uniformly represented heaving acceleration are determined according to a calculated Prony sequence parameter $Q_p$, that is:

$$f_p=\frac{Q_p+\mathcal{P}_p}{j2\pi}. \tag{13}$$

The determined frequencies are ordered, a minimum frequency component (low-frequency noise and a baseline drift caused by the acceleration sensor), namely the drift term, is removed from the frequencies to obtain the uniformly represented heaving acceleration measured value with the drift term being removed:

$$\ddot{z}_0(t)=\Sigma_{q=1}^{N}\mathcal{P}_q e^{\mathcal{Q}_q t} \tag{14}$$

In the formula, $\mathcal{P}_q$ and $Q_q$ are Prony sequence parameters used for uniformly representing the heaving acceleration measured value with the drift term being removed.

The heaving motion response is determined according to the uniformly represented heaving acceleration measured value with the drift term being removed:

$$\text{ff}_0^T \ddot{z}_0(t)dtdt = z_0(t) + z(0) + \dot{z}(0)t \quad (15).$$

That is, the relationship between the heaving acceleration and the heaving motion parameters is:

$$\int\int_0^T \sum_{q=1}^{N_q} \mathcal{P}_q e^{Q_q t} dtdt = \sum_{q=1}^{N_q} \frac{\mathcal{P}_q}{Q_q^2} e^{Q_q t} + \sum_{q=1}^{N_q} \frac{\mathcal{P}_q}{Q_q^2} + \sum_{q=1}^{N_q} \frac{\mathcal{P}_q}{Q_q} t. \quad (16)$$

Actual heaving motion parameters of the semi-submersible offshore platform are represented as:

$$z_0(t) = \sum_{q=1}^{N} \frac{\mathcal{P}_q}{Q_q^2} e_o^{Q_q t}. \quad (17)$$

In this embodiment, the drift term is removed from the uniformly represented heaving acceleration, that is, the low-frequency term that may cause a drift of the heaving motion parameters is removed; and then, the relationship between the heaving acceleration and the heaving motion parameters of the semi-submersible offshore platform is established according to the Prony sequence with the drift term being removed, so that the defects of traditional methods based on integration and filters are overcome.

According to the method for predicting heaving motion parameters of a semi-submersible offshore platform based on heaving acceleration provided by the invention, a motion equation in the heaving direction of the structure is deduced mainly based on a linearly potential flow theory, and the mathematic relation between the heaving acceleration and the heaving motion parameters of the semi-submersible offshore platform is established through a Prony sequence. According to the method, a noise signal, a slow signal caused by a tidal range and a baseline drift component caused by an acceleration sensor are uniformly represented first; then, a low-frequency component caused by a drift is removed through frequency screening, so that the baseline drift component and low-frequency noise caused by the acceleration sensor are removed; and finally, the mathematic relation between the Prony sequence of the heaving acceleration and the heaving motion response of the semi-submersible offshore platform is deduced by means of the remaining Prony sequence with the low-frequency component being removed, so that the relationship between the heaving acceleration and the heaving motion parameters of the structure is established. Different from traditional methods based on filters, the method of the invention establishes the transformational relation between heaving acceleration and displacement of the semi-submersible offshore platform through the Prony sequence rather than correcting heaving motion parameters by traditional integration and filters, thus having higher prediction precision. Besides, the method of the invention takes into consideration the influences of many factors, including the influence of the marine environment and the influence of sensors, thus having higher practical application value.

The method is verified below with a specific test example of the semi-submersible offshore platform.

Figure 2:
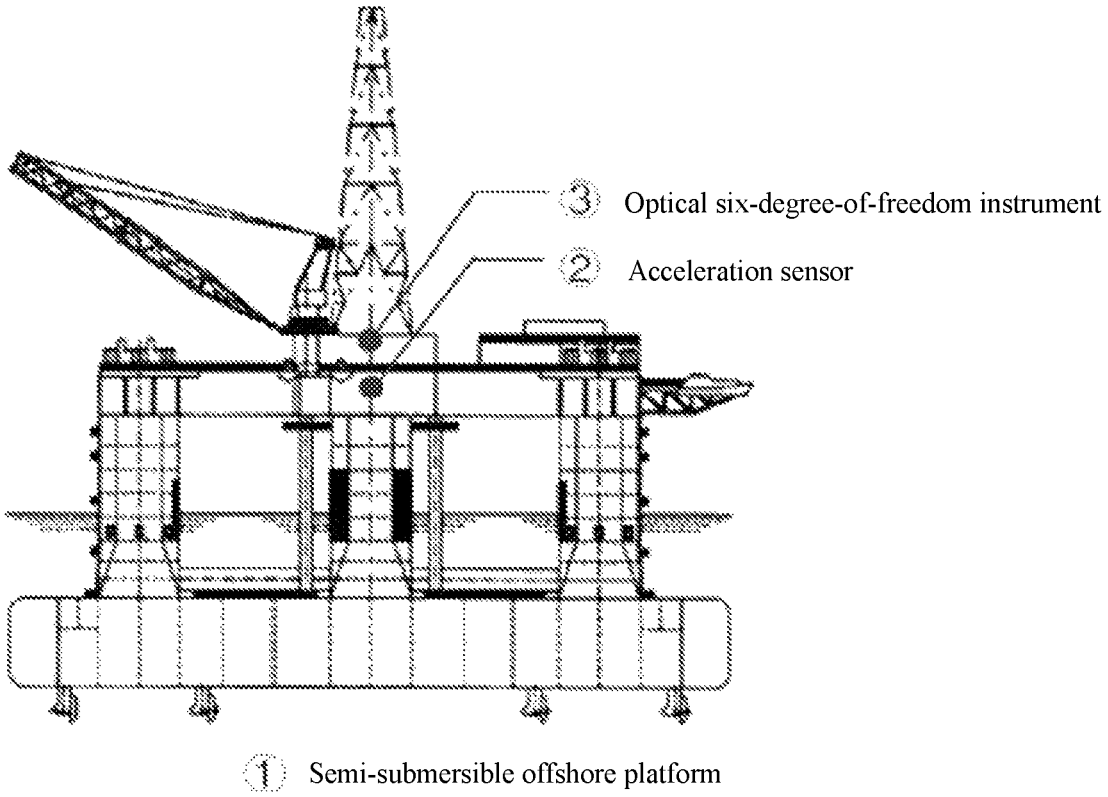
FIG. 2 is diagram of a test arrangement.

In this example, motion response data of a semi-submersible offshore platform placed in a wave tanks is used for calculation and analysis, and during a test, a wave maker is used to make waves, and an acceleration sensor is used to record heaving acceleration responses of the semi-submersible offshore platform. Besides, in order to verify the accuracy of a conversion result, an optical six-degree-of-freedom instrument is used to record heaving motion parameters of the structure. A test platform is constructed as shown in FIG. 2. During the test, the sampling frequency of a laser displacement sensor and the sampling frequency of the acceleration sensor are both set as 50 Hz.

Figure 3A:
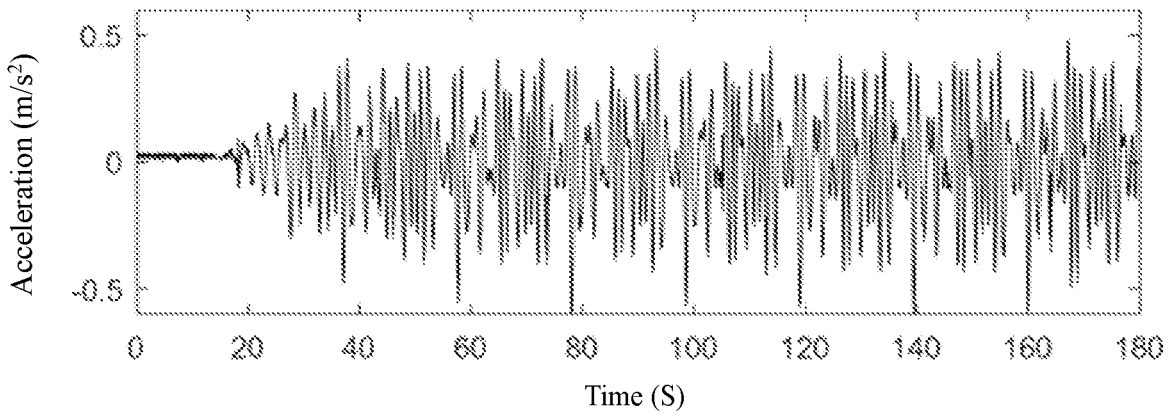
Figure 3B:
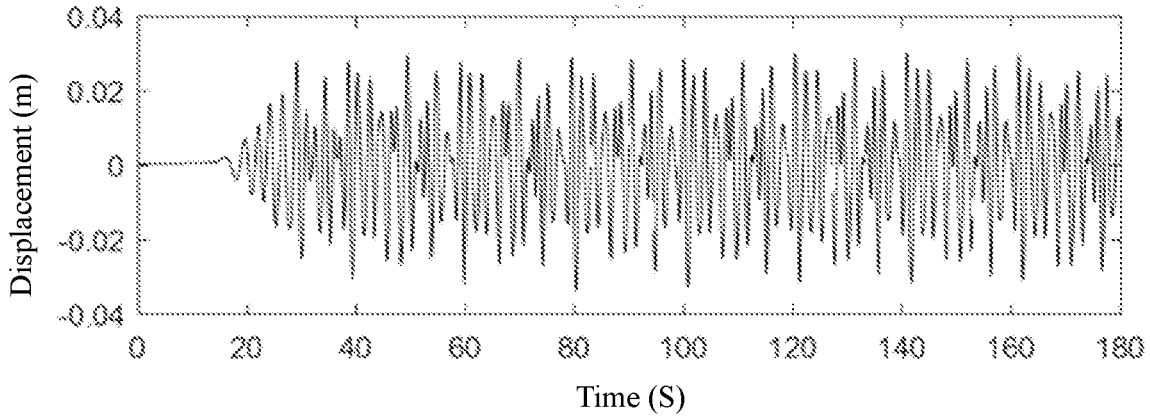

In this example, the heaving acceleration of the semi-submersible offshore platform recorded by the acceleration sensor is analyzed, and the heaving acceleration response of the platform under the action of waves obtained during the test is shown in FIG. 3A. Meanwhile, in order to verify the accuracy of heaving motion parameters obtained by analyzing the acceleration through the method, the optical six-degree-of-freedom instrument is used to record the heaving motion parameters of the semi-submersible offshore platform during the test, and the tested heaving motion parameters are shown in FIG. 3B. As can be seen from FIGS. 3A and 3B, the semi-submersible offshore platform starts to move from a static state, and considering the influence of the initial speed and the displacement, signals within 30-180 s in FIGS. 3A and 3B are selected for later analysis.

Figure 4A:
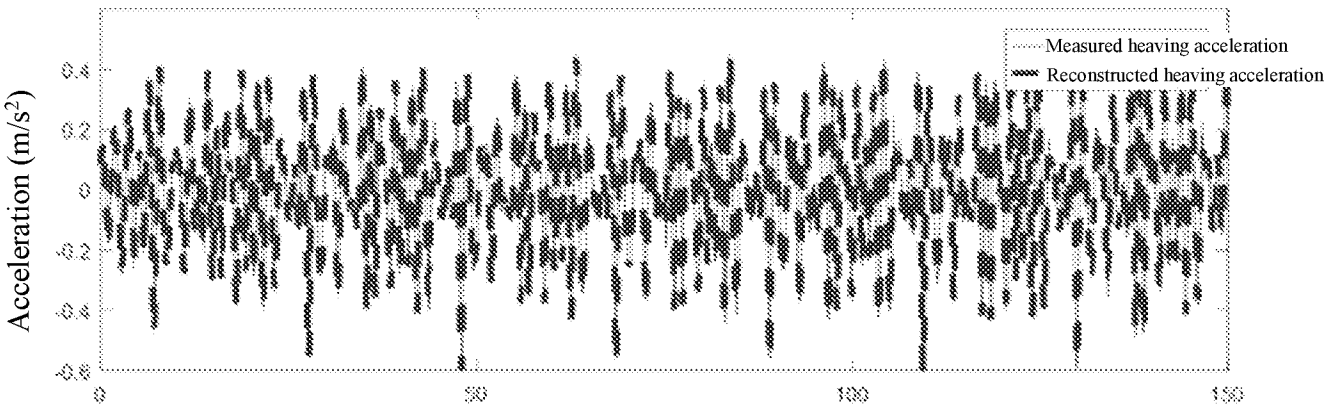
Figure 4B:
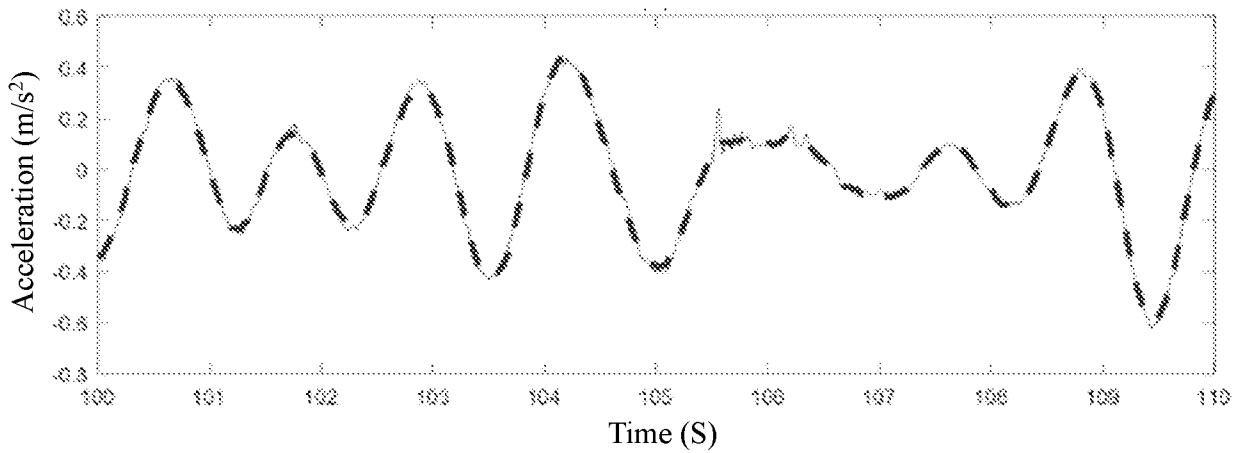

During analysis, the heaving acceleration theoretical value term, the noise term, the low-frequency change term and the baseline drift error term in the heaving acceleration measured value are represented by a unified Prony sequence first in terms of formula (12), and a representation result and tested acceleration are shown in FIG. 4A. As shown in FIG. 4B, representation results obtained within 100-110 s are partially amplified, and it can be seen that tested acceleration signals can be well represented by the Prony sequence. Then, the Prony sequence is screened in terms of formula (13) to remove low-frequency components therefrom to finally obtain a remaining Prony sequence, as shown in formula (14). Finally, the remaining Prony sequence is substituted into formula (15) to obtain heaving motion parameters corresponding to the heaving acceleration of the structure.

Figure 5A:
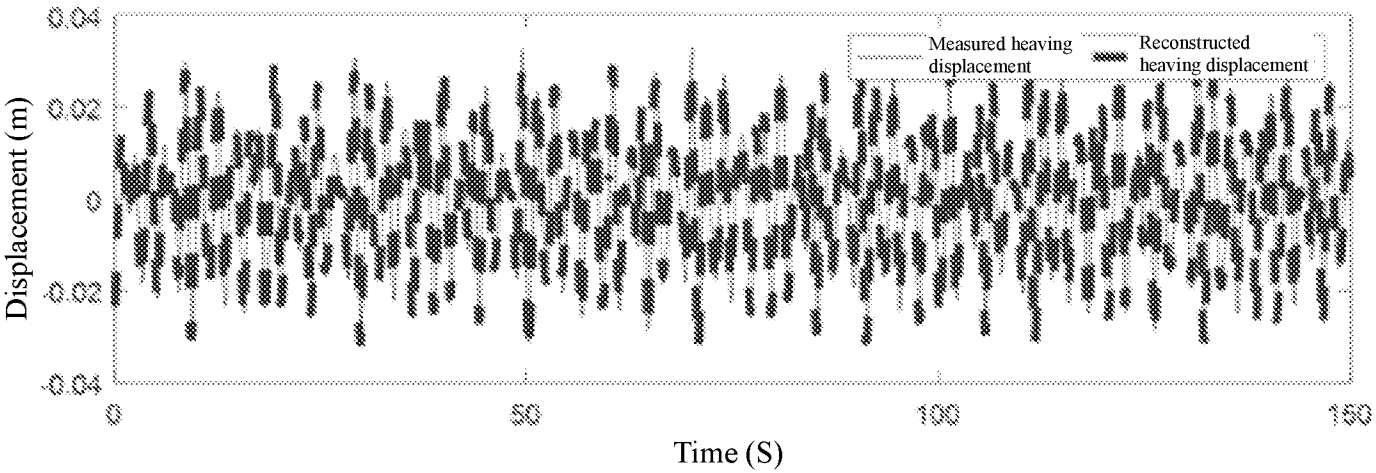
Figure 5B:
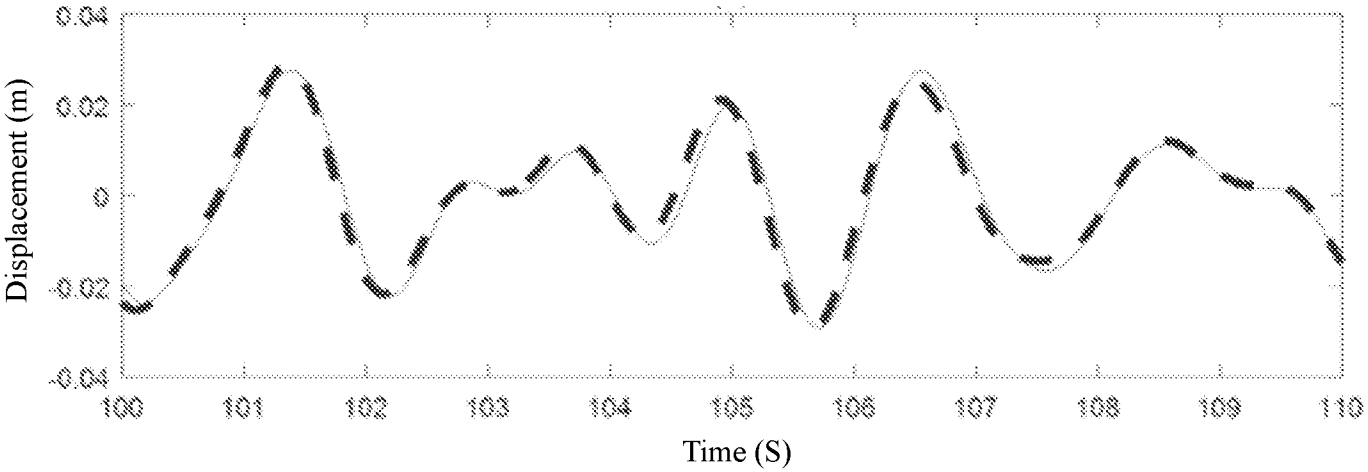

Then, actual heaving motion parameters of the semi-submersible offshore platform are reconstructed by means of the remaining Prony sequence with a drift term being filtered out, and a conversion result is shown in FIG. 5A. In FIG. 5B, the reconstructed result obtained within 100-110 s is partially amplified and is compared with the test result mentioned above, and it can be seen that the heaving motion parameters of the semi-submersible offshore platform tested by means of the remaining Prony sequence and the optical six-degree-of-freedom instrument have good consistency, which proves the validity of the method of the invention.

The above description is merely used to explain preferred embodiments of the invention, and is not intended to limit other forms of the invention. Any skilled in the art can change or modify these preferred embodiments into equivalent embodiments applied to other fields based on the technical contents disclosed above. Any simple amendments and equivalent modifications and transformations made to the above embodiments according to the technical essence of the invention without departing from the contents of the technical solutions of the invention should still fall within the protection scope of the technical solutions of the invention.

What is claimed is:

1. A method for predicting heaving motion parameters of a semi-submersible offshore platform based on heaving acceleration, comprising:

providing an acceleration sensor on the semi-submersible offshore platform to record heaving acceleration responses of the semi-submersible offshore platform;

in heaving motion of the semi-submersible offshore platform, representing heaving acceleration of the semi-submersible offshore platform based on a linear potential flow theory without regard to a coupling influence of addition mass and radiation damping to determine a heaving acceleration theoretical value;

in consideration of a noise influence of a heaving motion measurement marine environment of the semi-submersible offshore platform, a low-frequency influence caused by a slow change of the environment, and an influence caused by a baseline drift error of the acceleration sensor, introducing a noise term, a low-frequency change term, and a baseline drift error term to determine a heaving acceleration measured value;

uniformly representing a heaving acceleration theoretical value term, the noise term, the low-frequency change term, and the baseline drift error term in the heaving acceleration measured value by a unified Prony sequence; and removing a drift term from a uniformly represented heaving acceleration, establishing a relationship between the heaving acceleration and the heaving motion parameters of the semi-submersible offshore platform in terms of a remaining Prony sequence with the drift term being removed, and estimating the heaving motion parameters of the semi-submersible offshore platform.

2. The method according to claim 1, wherein:

in the heaving motion of the semi-submersible offshore platform, without regard to the coupling influence of the addition mass and the radiation damping and in consideration of a wave force, a restoring force, and a radiation force applied to the semi-submersible offshore platform in fluid, the heaving motion is expressed, based on the linear potential flow theory, as:

$$m\ddot{z}_0(t)=f_w(t)+f_m(t)+f_s(t)+f_r(t) \quad (1),$$

wherein m represents mass of the semi-submersible offshore platform, $\ddot{z}_0(t)$ represents the heaving acceleration of the semi-submersible offshore platform, $f_w(t)$ represents a wave load applied to the semi-submersible offshore platform, $f_m(t)$ represents a mooring force applied to the semi-submersible offshore platform, $f_s(t)$ represents the restoring force applied to the semi-submersible offshore platform, and $f_r(t)$ represents the radiation force applied to the semi-submersible offshore platform;

wherein the restoring force $f_s(t)$ is expressed as:

$$f_s t)=-c_z z_o(t)=-\rho g A_w z_o(t) \quad (2),$$

wherein $z_o(t)$ represents a vertical displacement of the semi-submersible offshore platform; $c_z$ is a restoring stiffness of the semi-submersible offshore platform in a heaving direction, which is related to an area $A_w$ of a water plane, a fluid density ρ, and gravitational acceleration g;

the radiation force $f_r(t)$ is expressed as:

$$f_r(t)=-m_\infty\ddot{z}_0(t)\int_0^t k_z(t-\tau)\dot{z}_o(t)d\tau \quad (3),$$

wherein $\dot{z}_0(t)$ represents a velocity of the semi-submersible offshore platform in the heaving direction, and $m_\infty$ and $k_z$ are respectively additional mass and a pulse response function at an infinite frequency in the heaving direction;

in terms of formulas (1)-(3), the heaving motion of the semi-submersible offshore platform is expressed as:

$$(m+m_\infty)\ddot{z}_0(t)=f_0(t)-c_z z_o(t)-\int_0^t k_z(t-\tau)\dot{z}_o(t)d\tau \quad (4),$$

wherein $f_0(t)=f_w(t)=f_m(t)$;

the heaving acceleration theoretical value of the semi-submersible offshore platform is expressed as:

$$\ddot{z}_0(t)=\frac{1}{m+m_\infty}\left\{f_0(t)-c_z z_0(t)-\int_0^t k_z(t-\tau)\dot{z}_0(t)d\tau\right\}, \quad (5)$$

theoretically, the heaving acceleration of the semi-submersible offshore platform is modeled into a group of superimposed harmonic waves, in terms of formula (5), the heaving acceleration theoretical value is represented as:

$$\ddot{z}_0(t)=\Sigma_{i=1}^{N_i}A_i\cos(2\pi f_i t+\theta_i)=\Sigma_{i=1}^{N_i}U_i e^{v_i t} \quad (6),$$

wherein $A_i$, $f_i$, and $\theta_i$ represent an amplitude, a frequency, and a phase of an $i^{th}$ component in the heaving acceleration respectively, and $U_i$ and $V_i$ are parameters used for fitting the heaving acceleration theoretical value of the semi-submersible offshore platform by a Prony sequence.

3. The method according to claim 2, wherein:

in consideration of the noise influence of the heaving motion measurement marine environment of the semi-submersible offshore platform, the low-frequency influence caused by the slow change of the heaving motion measurement marine environment, and the influence caused by the baseline drift error of the acceleration sensor, the heaving acceleration measured value is determined by introducing the noise term, the low-frequency change term, and the baseline drift error term as follows:

$$\ddot{z}_0(t)=\ddot{z}_o(t)+n(t)+v(t)+b \quad (7),$$

wherein n(t) represents the noise term, v(t) represents the low-frequency change term, and b represents the baseline drift error term.

4. The method according to claim 3, wherein:

the Prony sequence is introduced to represent the noise term, the low-frequency change term, and the baseline drift error term in the heaving acceleration measured value as follows:

$$n(t)=\Sigma_{n=1}^{N_n}A_n e^{i\theta_n}e^{(-\xi_n+j2\pi f_n)t}=\Sigma_{n=1}^{N_n}\mathcal{A}_n e^{\mathcal{B}_n t} \quad (8),$$

In the formula, $j=\sqrt{-1}$, $\mathcal{A}_n=A_n e^{i\theta_n}$, $\mathcal{B}_n=-\xi_n+j2\pi f_n$, wherein $A_n$, $f_n$, $\zeta_n$ and $\theta_n$ represent an amplitude, a frequency, damping and a phase of each component in the noise term respectively;

$$v(t)=\Sigma_{v=1}^{N_v}A_v e^{j\theta_v}e^{(-\xi_v+j2\pi f_v)t}=\Sigma_{v=1}^{N_v}C_v e^{D_v t} \quad (9),$$

wherein $C_v=A_v e^{i\theta_v}$, $D_v=-\xi_v+j2\pi f_v$, wherein $A_v$, $f_v$, $\xi_v$ and $\theta_v$, represent an amplitude, a frequency, damping and a phase of each component in the low-frequency change term respectively;

$$b=Ee^{Ft} \quad (10),$$

wherein E and F are parameters used for fitting the baseline drift error term;

in terms of formulas (6)-(10), the heaving acceleration theoretical value term, the noise term, the low-frequency change term, and the baseline drift error term in the heaving acceleration measured value are represented by the unified Prony sequence to obtain:

$$\ddot{z}_0(t)=\Sigma_{i=1}^{N_i}U_i e^{v_i t}+\Sigma_{n=1}^{N_n}\mathcal{A}_n e^{\mathcal{B}_n t}+\Sigma_{v=1}^{N_v}C_v e^{D_v t}+Ee^{Ft} \quad (11),$$

further, the heaving acceleration measured value is uniformly represented as:

$$\ddot{z}_0(t)=\Sigma_{p=1}^{N}\mathcal{P}_p e^{Q_p t} \quad (12),$$

wherein $N_p=N_i+N_n+N_v+1$, and $P_p$ and $Q_p$ are Prony sequence parameters used for uniformly representing the heaving acceleration of the semi-submersible offshore platform by the Prony sequence.

5. The method according to claim 4, wherein frequencies of all components of the uniformly represented heaving acceleration are determined according to the calculated Prony sequence parameter $Q_p$ as follows:

$$f_p = \frac{Q_p + \mathcal{P}_p}{j2\pi}, \quad (13)$$

the frequencies determined are ordered, the drift term is a minimum frequency component, and the drift term is removed from the frequencies to obtain the uniformly represented heaving acceleration measured value with the drift term being removed:

$$\bar{\ddot{z}}_0(t)=\Sigma_{q=1}^{N}\mathcal{P}_q e^{Q_q t} \quad (14),$$

wherein $P_q$ and $Q_q$ are Prony sequence parameters used for uniformly representing the heaving acceleration measured value with the drift term being removed by the Prony sequence.

6. The method according to claim 5, wherein:

a heaving motion response is determined according to a uniformly represented heaving acceleration measured value with the drift term being removed:

$$\iint_0^T \bar{\ddot{z}}_0(t)dtdt=z_0(t)+z(0)+\dot{z}(0)t \quad (15),$$

wherein the relationship between the heaving acceleration and the heaving motion parameters is:

$$\int\int_0^T \sum_{q=1}^{N_q} \mathcal{P}_q e^{Q_q t} dtdt = \sum_{q=1}^{N_q} \frac{\mathcal{P}_q}{Q_q^2} e^{Q_q t} + \sum_{q=1}^{N_q} \frac{\mathcal{P}_q}{Q_q^2} + \sum_{q=1}^{N_q} \frac{\mathcal{P}_q}{Q_q} t, \quad (16)$$

and actual heaving motion parameters of the semi-submersible offshore platform are represented as:

$$z_0(t) = \sum_{q=1}^{N} \frac{\mathcal{P}_q}{Q_q^2} e^{Q_q t}. \quad (17)$$

* * * * *